US009326064B2

(12) United States Patent
Duraiswami et al.

(10) Patent No.: US 9,326,064 B2
(45) Date of Patent: Apr. 26, 2016

(54) MICROPHONE ARRAY CONFIGURATION AND METHOD FOR OPERATING THE SAME

(71) Applicants: Ramani Duraiswami, Highland, MD (US); Adam O'Donovan, Bethesda, MD (US); Dmitry Zotkin, Greenbelt, MD (US)

(72) Inventors: Ramani Duraiswami, Highland, MD (US); Adam O'Donovan, Bethesda, MD (US); Dmitry Zotkin, Greenbelt, MD (US)

(73) Assignee: VisiSonics Corporation, Highland, MD (US)

( * ) Notice: Subject to any disclaimer, the term of this patent is extended or adjusted under 35 U.S.C. 154(b) by 460 days.

(21) Appl. No.: 13/647,221

(22) Filed: Oct. 8, 2012

(65) Prior Publication Data

US 2013/0121505 A1 May 16, 2013

Related U.S. Application Data

(60) Provisional application No. 61/545,180, filed on Oct. 9, 2011.

(51) Int. Cl.

| | |
|---|---|
| ***H04R 3/00*** | (2006.01) |
| *H04R 1/40* | (2006.01) |
| *H04R 3/02* | (2006.01) |

(52) U.S. Cl.

CPC ..... *H04R 3/005* (2013.01); *H04R 1/406* (2013.01); *H04R 3/02* (2013.01); *H04R 2201/401* (2013.01); *H04R 2420/09* (2013.01)

(58) Field of Classification Search

CPC ..... H04R 3/005

See application file for complete search history.

(56) References Cited

U.S. PATENT DOCUMENTS

| | | | | |
|---|---|---|---|---|
| 2007/0076899 | A1* | 4/2007 | Hsu | H04R 3/005 381/92 |
| 2007/0274534 | A1* | 11/2007 | Lockhart | H04R 1/406 381/92 |
| 2008/0285770 | A1* | 11/2008 | Wu | H04R 1/406 381/92 |

OTHER PUBLICATIONS

J. McDonough and K. Kumatani (2012), "Microphone arrays, in Techniques for Noise Robustness in Automatic Speech Recognition", ed. By T. Virtanen, R. Singh, and B. Raj, John Wiley & Sons, Inc., Hoboken, NJ.

A. A. Salah et al. (2008). "Multimodal identification and localization of users in a smart environment", Journal on Multimodal User Interfaces, vol. 2(2), pp. 75-91.

(Continued)

*Primary Examiner* — Duc Nguyen
*Assistant Examiner* — Yogeshkumar Patel
(74) *Attorney, Agent, or Firm* — Foley & Lardner LLP

(57) ABSTRACT

An apparatus comprises a plurality of microphone units including at least a first microphone unit and a second microphone unit, each of the first and second microphone units comprising a microphone, an analog-to-digital converter, and a local memory. The microphone is configured to capture an analog audio signal. The analog-to-digital converter is configured to convert the analog audio signal created by the microphone into a digital audio signal. The local memory is configured to store the digital audio signal. The apparatus further comprises. a controller unit comprising a processor configured to process the digital audio signals. The first microphone unit and the second microphone unit are operatively connected to the controller unit in a series configuration, the second microphone unit being configured to output the digital audio signal to the first microphone unit, and the first microphone unit being configured to output the digital audio signal to the controller unit.

23 Claims, 14 Drawing Sheets

(56) References Cited

OTHER PUBLICATIONS

A. E. O'Donovan, R. Duraiswami, and J. Neumann (2007). "Microphone arrays as generalized cameras for integrated audiovisual processing", Proc. IEEE CVPR 2007, Minneapolis, MN.

B. D. V. Veen and K. M. Buckley (1998)."Beamforming: a versatile approach to spatial filtering", IEEE ASSP Magazine, vol. 5(2), pp. 4-24.

D. N. Zotkin, R. Duraiswami, E. Grassi, and N. A. Gumerov (2006). "Fast head-related transfer function measurement via reciprocity", Journal of the Acoustical Society of America, vol. 120(4), 2006, pp. 2202-2215.

H. Zumbahlen, ed. (2006). "Linear Circuit Design Handbook", Elsevier / Newnes, The Netherlands, chapter 6.

J. M. Sachar, H. F. Silverman, and W. R. Patterson (2005), "Microphone position and gain calibration for a large-aperture microphone array", IEEE Transactions on Speech and Audio Processing, vol. 13(1), pp. 42-52.

M. Brandstein and D. Ward, eds. (2001). "Microphone Arrays: Signal Processing Techniques and Applications", Springer-Verlag, Berlin, Germany (Table of Contents).

* cited by examiner

C = Chain or group number
M = Microphone number

MICROPHONE ARRAY CONFIGURATION AND METHOD FOR OPERATING THE SAME

CROSS-REFERENCE TO RELATED APPLICATIONS

This application claims priority to U.S. Provisional Patent Application Ser. No. 61/545,150 filed Oct. 9, 2011, commonly assigned, and hereby incorporated by reference in its entirety.

TECHNICAL FIELD

The present disclosure is related the field of microphone arrays having a configuration that includes a plurality of interconnected microphones.

BACKGROUND

At the current state of the art in technology, multimedia processing is starting to become ubiquitous, and smart multimodal data capture and processing systems are at the edge of becoming universally used by individuals in their households. While large advances have been made in video processing, the audio counterpart is comparatively underdeveloped. The main reason for that is that the untethered (distant) acquisition of high-quality audio signals (e.g., of a human speech) requires a microphone array—a number of spatially separated microphones whose signals are processed in a way as to enhance the desired audio input and to suppress the undesired audio input.

Multichannel signal processing and microphone array research have very rich history. See, for example. M. Brandstein and D. Ward, eds. (2001). "Microphone Arrays: Signal Processing Techniques and Applications", Springer-Verlag, Berlin, Germany. A common task in setting up a micro-phone array is to physically and electronically connect all microphones to the digitization hardware and further to the processing unit. Typically, a separate amplifier is used for each microphone, and each amplifier's output is fed to a separate channel of a analog-to-digital conversion (ADC) board. Such an architecture is heavily parallel, with one individual cable per microphone and all cables converging at a central hub. When the number of microphones becomes large, the amount of wiring involved makes the resulting system quite cumbersome.

A microphone array may comprise a number of individual microphones that are connected to a central processing unit. The microphones may each record their own independent audio signals and may be engaged in communication with one another and with the central processing unit for the purposes of recording synchronization and data transfer. Conventional microphone array configurations may have separate individual connections from the central processor to every microphone in the array, which may severely limit the flexibility and scalability of the microphone array system. Additionally, the digitization of the signal may occur only at the central processing unit, leaving the analog signals susceptible to noise and signal degradation over the signal transfer path. Further, a single analog-to-digital converter chip with multiplexed input may be used to perform analog-to-digital conversion for several microphones in the array, resulting in a non-simultaneous sampling on individual channels and ultimately in degradation of system's performance.

All references cited herein are hereby incorporated by reference in their entireties.

SUMMARY

In embodiments of the present invention, an alternative architecture is provided. The architecture is based on building a basic "microphone unit" by combining a microphone and an ADC chip on a small printed circuit board (PCB) and on connecting these microphone units sequentially into the chains of substantial length.

In one embodiment, an apparatus comprises a plurality of microphone units including at least a first microphone unit and a second microphone unit, each of the first and second microphone units comprising a microphone, an analog-to-digital converter, and a local memory. The microphone is configured to capture an analog audio signal. The analog-to-digital converter is configured to convert the analog audio signal created by the microphone into a digital audio signal. The local memory is configured to store the digital audio signal. The apparatus further comprises a controller unit comprising a processor configured to process the digital audio signals. The first microphone unit and the second microphone unit are operatively connected to the controller unit in a series configuration. The second microphone unit is configured to output the digital audio signal to the first microphone unit. The first microphone unit is configured to output the digital audio signal to the controller unit.

In one aspect, each of the first and second microphone units further comprises a pre-amplifier configured to amplify the analog audio signal captured by the microphone In one aspect, each of the first and second microphone units further comprises a pre-amplifier configured to amplify the analog audio signal captured by the microphone, and the apparatus further comprising a controlling circuit configured to send a signal to the pre-amplifier to apply a predetermined gain.

In one aspect, the apparatus further comprises a controlling circuit configured to provide a clock pulse that triggers the analog-to-digital converters to convert the analog audio signal created by the microphone into the digital audio signal and to perform the output of the digital audio signal.

In one aspect, the second microphone unit is operatively connected to the first microphone unit via a patch cable.

In one aspect, the apparatus comprises a chain of at least four of the microphone units operatively connected to the controller unit in a series configuration.

In one aspect, the apparatus comprises at least two separate chains of the microphone units operatively connected to the controller unit in a parallel configuration, each of the microphone units of the at least two chains being operatively connected to the controller unit in a series configuration.

In one aspect, the apparatus comprises at least two separate chains of the microphone units operatively connected to the controller unit in a parallel configuration, each of the microphone units of the at least two chains being operatively connected to the controller unit in a series configuration, and each of the at least two chains comprises at least four of the microphone units connected in a series configuration.

In one aspect, the apparatus comprises at least four separate chains of the microphone units operatively connected to the controller unit in a parallel configuration, each of the microphone units of the at least four chains being operatively connected to the controller unit in a series configuration, and each of the at least four chains comprises at least sixteen of the microphone units connected in a series configuration.

In one aspect, the local memory is a part of the analog-to-digital converter.

In one aspect, the apparatus comprises a chain of at least four of the microphone units operatively connected to the controller unit in a series configuration, and the microphone units in the chain are configured to transmit the digital audio signals to the controller unit in order of proximity to the controller unit along the chain.

In one aspect, the controller unit further comprises a memory configured to store the digital audio signals in order based on a time each of the audio signal samples are received.

In one aspect, the controller unit further comprises a memory configured to store the digital audio signals in an order based on a time that each of the audio signal samples are received, and the processor is configured to process the plurality of audio signal samples based on the order in which the memory stores the digital audio signals.

In one aspect, the controller unit further comprises a memory configured to store the digital audio signals in an order based on a time that each of the audio signal samples are received, and a time that each of the audio signal samples are received is based on a chain number and microphone number associated with each of the digital audio signals received.

In one aspect, the apparatus comprises at least two separate chains of the microphone units operatively connected to the controller unit in a parallel configuration, each of the microphone units of the at least two chains being operatively connected to the controller unit in a series configuration, and the controller unit is configured to receive the digital audio signals from one microphone unit at a time by alternating between the at least two separate chains.

In one aspect, the controller unit comprises a Universal Serial-Bus (USB) interface configured to transmit processed digital audio signals to a computing device.

In one aspect, the apparatus comprises a chain of at least four of the microphone units operatively connected to the controller unit in a series configuration, and the apparatus further comprises a signal booster operatively connected in series between at least two of the at least four of the microphone units.

In one aspect, the processor is configured for generating an audio image based on the digital audio signals.

In one aspect, the processor is configured to perform an echo-cancellation process on the digital audio signals.

In one aspect, the processor is configured to provide an audio image based on the digital audio signals.

In another embodiment, a method comprises providing a plurality of microphone units including at least a first microphone unit and a second microphone unit, each of the first and second microphone units comprising a microphone, an analog-to-digital converter, and a local memory. The microphone is configured to capture an analog audio signal. The analog-to-digital converter is configured to convert the analog audio signal created by the microphone into a digital audio signal. The local memory is configured to store the digital audio signal. The method further comprises providing a controller unit comprising a processor configured to process the digital audio signals; and operatively connecting the first microphone unit and the second microphone unit to the controller unit in a series configuration, such that the second microphone unit is configured to output the digital audio signal to the first microphone unit, and the first microphone unit is configured to output the digital audio signal to the controller unit.

In one aspect, the method comprises attaching a plurality of separate chains of the microphone units to the controller unit, wherein a number of separate chains of the microphone units and a number of the microphone units in each separate chain are chosen to optimize a pre-determined cost function.

In one aspect, the method comprises attaching a plurality of separate chains of the microphone units to the controller unit, and wherein a number of separate chains of the microphone units and the number of the microphone units in each separate chain are chosen to minimize the total cabling length required.

In another embodiment, an apparatus comprises a receiver configured to receive a plurality of audio signal samples corresponding to a plurality of microphones operating in a microphone array; a memory configured to store the audio signal samples in order based on a time each of the audio signal samples were received; and a processor configured to process the plurality of audio signal samples corresponding to an order the audio signal samples were received.

In one aspect, the order of stored audio signal samples corresponds to a particular chain number and microphone number associated with each of the audio signal samples received.

In one aspect, the apparatus further comprises a universal serial-bus (USB) interface configured to transmit the processed audio signals to a computing device.

In one aspect, each of the audio signal samples comprise 24 bits of data.

In one aspect, the audio signal samples comprise at least one of 2, 4, 8, 16, 32 and 64 different samples corresponding to at least one of 2, 4, 8, 16, 32 and 64 different microphones of the microphone array.

In one aspect, the apparatus further comprises at least two data interfaces configured to receive the audio signal samples. A first interface is configured to receive a first audio signal sample corresponding to a first microphone of a first chain connected to the first interface, and a second interface is configured to receive a second audio signal sample corresponding to a first microphone of a second chain connected to a second interface different from the first interface.

In one aspect, the first audio signal sample is placed in a queue in a first position and the second audio signal sample is placed in the queue in a second position.

DETAILED DESCRIPTION

Figure 1A:
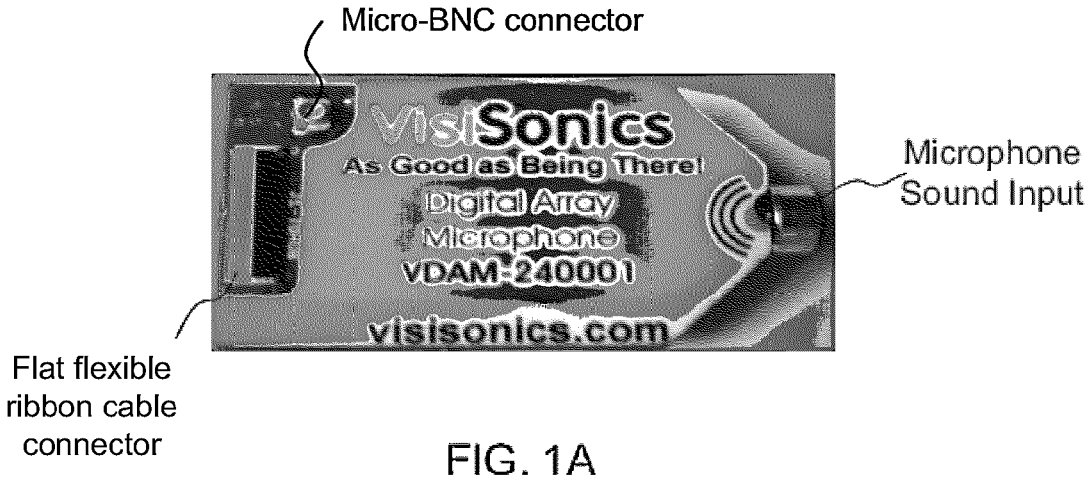
FIG. 1A illustrates an example microphone unit front view perspective.

Individual microphones come in a variety of shapes and sizes. By far, the most common type currently in use is electret. A higher signal quality is associated with condenser microphone; however, these require phantom power for operation. Dynamic microphones operate using a principle reverse to that of the loudspeaker and tend to have relatively narrow operational bandwidth. Ribbon microphones operate similarly to the dynamic ones but respond to the pressure gradient (as opposed to the pressure itself). A relatively new development is a MEMS microphone, where the mechanical membrane is carved out directly from the silicone substrate; these are extremely small but about 10-15 dB noisier than conventional electret ones. There is also a host of other, more exotic microphone varieties. Almost all microphones utilize a pre-amplifier (often built-in in the microphone cartridge). For digital processing of the recorded signals, ADC hardware may be used. General characteristics of the audio processing chain (microphone, pre-amp, and ADC) are sensitivity, frequency response, noise floor, signal-to-noise ratio, sampling frequency, and sampling bit depth.

In the most general form, a microphone array is a collection of microphones located at known, spatially distinct locations. Differences in the acoustic signals recorded allow one to infer the spatial structure of the acoustic field and to obtain related information such as sound source(s) position(s). See, for example, A. A. Salah et al. (2008). "Multimodal identification and localization of users in a smart environment", Journal on Multimodal User Interfaces, vol. 2(2), pp. 75-91. Conversely, if the field structure is known, one can apply spatial filtering so as to amplify or suppress certain parts of the audio scene. See, for example, B. D. V. Veen and K. M. Buckley (1998). "Beamforming: a versatile approach to spatial filtering", IEEE ASSP Magazine, vol. 5(2), pp. 4-24. Various array configurations are possible, including, for example, linear, planar, and spherical arrays. Each of these has certain advantages and disadvantages and is suitable for specific types of applications; for example, the spherical array has fully symmetrical coverage of the three-dimensional space surrounding the array, which can be used to provide co-registered multimodal (video and audio) images. See, for example, A. E. O'Donovan, R. Duraiswami, and J. Neumann (2007). "Microphone arrays as generalized cameras for integrated audiovisual processing", Proc. IEEE CVPR 2007. Minneapolis, Minn. A microphone array system may include a "common clock" to synchronize data capture and may undergo a calibration procedure to have identical magnitude/phase response across all microphones (or to compensate for inter-microphone differences). Also, for arrays larger than a few microphones, engineering issues such as power consumption, heat dissipation, physical array size, cabling, electromagnetic interference (EMI), and space requirements often pose additional challenges.

Traditionally, a microphone array is built in a parallelized fashion. Each microphone may have a (possibly built-in) pre-amplifier, and the audio signal travels over the microphone cable to another amplifier (possibly combined with signal conditioner) and then to the multichannel ADC board typically installed in a desktop computer. The array built in this fashion has a number of weak points: involvement of bulky hardware and lack of portability; excessively large amount of cabling required; the need for sturdy mounting hardware and acoustic interference from it; presence of multiple points of failures at cables' connectors; EMI susceptibility of analog signals in transit; and non-simultaneous sampling due to sequential operation of the ADC board. One example of a relatively large array is a 128-element array used for reciprocal HRTF measurement at the University of Maryland. See D. N. Zotkin, R. Duraiswami, E. Grassi, and N. A. Gumerov (2006). "Fast head-related transfer function measurement via reciprocity", Journal of the Acoustical Society of America, vol. 120(4), 2006, pp. 2202-2215. The array was set up using four 32-channel NI PCI-6071E data acquisition cards, four 32-channel custom amplifier boxes, and 128 Knowles FG-3629 microphones. Another example of a large array is a 512-element Huge Microphone Array (HMA) project at Brown University. See J. M. Sachar, H. F. Silverman, and W. R. Patterson (2005), "Microphone position and gain calibration for a large-aperture microphone array," IEEE Transactions on Speech and Audio Processing, vol. 13(1), pp. 42-52. The latter was built using specialized DSP hardware and avoids some of the aforementioned problems; however, the equipment, cabling, and space requirements make it non-portable.

As an alternative architecture, embodiments of the present invention utilize a chain design. In the chain architecture, individual microphone units may include an analog-to-digital converter located immediately next to the microphone to reduce EMI, and the circuitry may be designed for connecting these units in a serial fashion so that each unit sends the ADC conversion results to the output data connector and then relays whatever data is presented at the input data connector to the output. The unit located at the far end of chain may have its input data connector grounded and its output data connector connected to the input data connector of the next unit. The units may be interconnected in a similar fashion through the whole chain, and the first unit (the one at the near end of the chain) relays the data from the whole chain to the data consumer.

The chain architecture avoids all the above-mentioned problems associated with hub-and-spoke architecture. In particular, a bulky set of long cables (one per each microphone) is replaced with short links connecting individual microphone units together. However, a single cable or board failure in chain architecture may render the rest of the chain disconnected. To minimize a possibility of such event, one can encase a microphone array (if permitted by application) into a physical "black box" so that all inter-unit cables are securely mounted inside and interfacing with the array is done via a single cable.

FIG. 1A illustrates an example microphone unit front view perspective according to an example embodiment. In this example embodiment, the microphone units are linked into the chain using 2 (two) cables: an 18-wire flat flexible ribbon cable (FFC) (used to carry the low-frequency signals) and a miniature coaxial cable (used to carry high-frequency data read clock). Referring to FIG. 1A, the microphone unit front provides user with an access to the FFC cable connector and a micro-BNC connector for the coaxial cable (on the left side of the figure). These connectors are used to connect the microphone unit to the previous microphone unit (i.e. to the microphone unit that is one step closer to the hub). The microphone capsule (the acoustic signal receiver) is located at the opposite end of the printed circuit board (on the right side of the figure. The vertical side is approximately 2.3 cm; the horizontal sides are approximately 3.1 cm. The tapered edge brings the side length down to 8 mm over a horizontal length of about 8 mm. The microphone capsule is 6 mm in diameter.

Figure 1B:
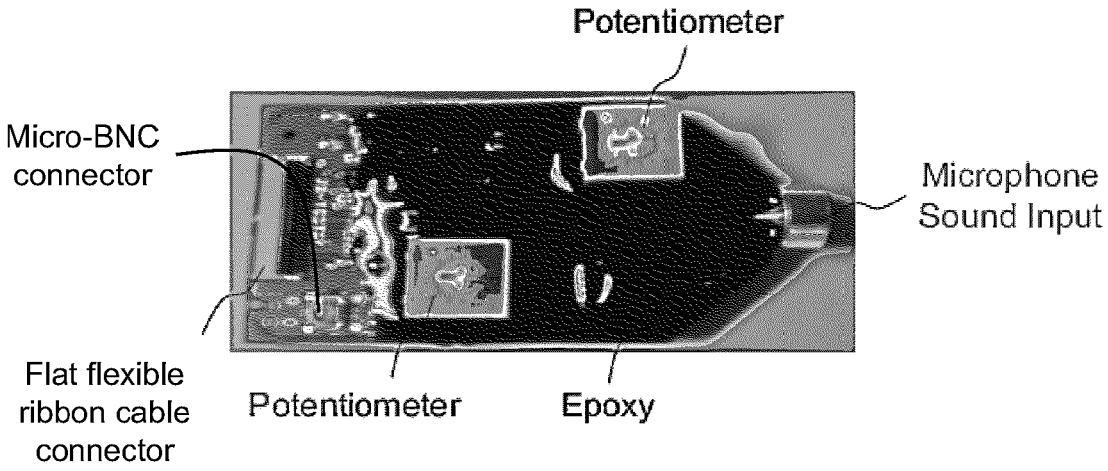
FIG. 1B illustrates an example microphone unit rear view perspective.

FIG. 1B illustrates an example microphone unit rear view perspective according to an example embodiment. The back side is covered in an epoxy compound to prevent short circuits. Two interface connectors (FFC and micro-BNC) are on the left side. These connectors are used to connect the microphone unit to the next microphone unit (i.e. to the microphone unit that is one step further from the hub). The back side also includes two potentiometers for pre-amplifier gain and for ADC voltage trim, which may be used for microphone unit calibration. Such tuning, adjusting, or calibration procedure may provide fine control of the signal gain.

A microphone unit may include a microphone capsule and a pre-amplifier stage, which amplifies the raw microphone capsule output (i.e., the sound signal). One of the potentiometers located on the rear side of the microphone unit may be used to manually adjust the gain level. This may adjust the pre-amplifier circuit gain to ensure that each microphone unit in the array can be calibrated to output approximately the same digitized data for a fixed energy of impinging acoustic signal. After the individual units' gains in a particular array are closely matched, another level of gain control may be implemented. For instance, a programmable gain may be used by sending one of the several signals from the hub to the microphone unit to apply a predetermined gain (1, 2, 5, 10, 20, 50, 100, etc.) to the received signal. This gain process permits the user to adjust the microphone array response to match the signals of interest.

After the pre-amplifier stage, the analog-to-digital (ADC) conversion stage may be used to digitize the captured analog signals via a 24-bit analog-to-digital converter (Sigma-Delta or SAR). The second potentiometer located on the rear side of the microphone unit may be used to adjust the reference voltage supplied to the ADC to closely match the pre-determined value for said reference voltage and to be approximately the same across all microphone units in the array, ensuring that each microphone unit in the array can be further calibrated.

To start the digitization, the controlling circuit provides a clock pulse, which triggers the ADC to digitize the received signal at the rate specified by the clock (e.g., 44100 Hz). Each time a clock signal initiates sampling, a 24-bit number is generated from the captured signal. The same clock is shared by all microphone units in a microphone array configuration so that each microphone unit simultaneously captures the same sound field via its own unique audio perspective. Each microphone unit may store the digitized sample to a local memory (not shown) included on the printed circuit board of FIGS. 1A and 1B. The audio signals received, processed, digitized, and stored by the individual microphone units are periodically transmitted as digital data over the bus interconnecting individual microphone units.

Figure 2A:
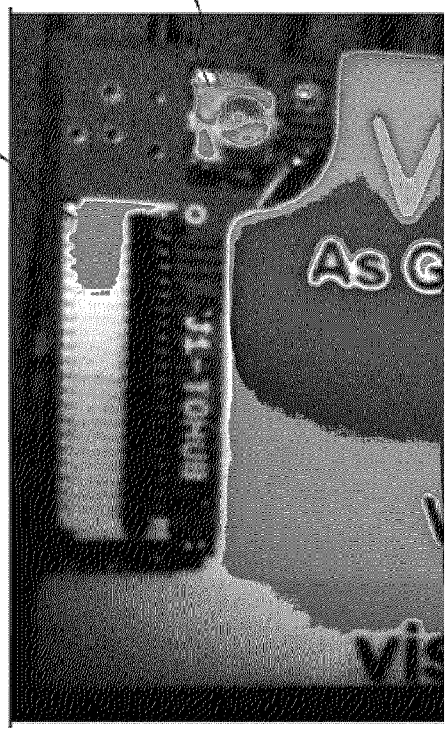
FIG. 2A illustrates an example microphone unit lower-end front view perspective.
Figure 2B:
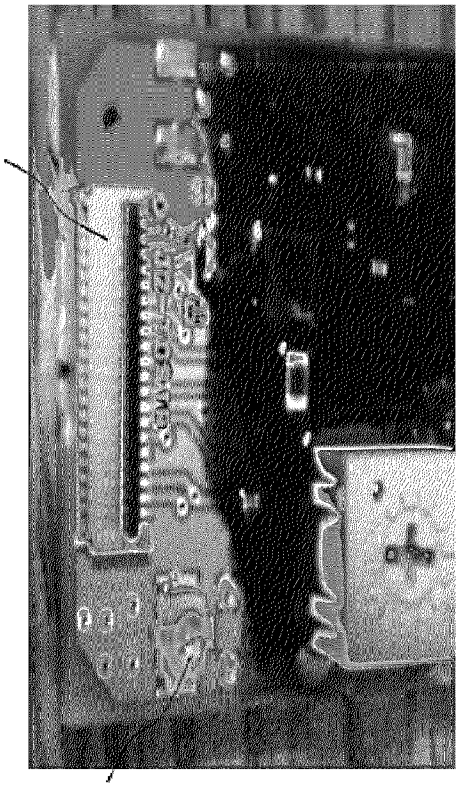
FIG. 2B illustrates an example microphone unit lower-end rear view perspective.
Figure 3A:
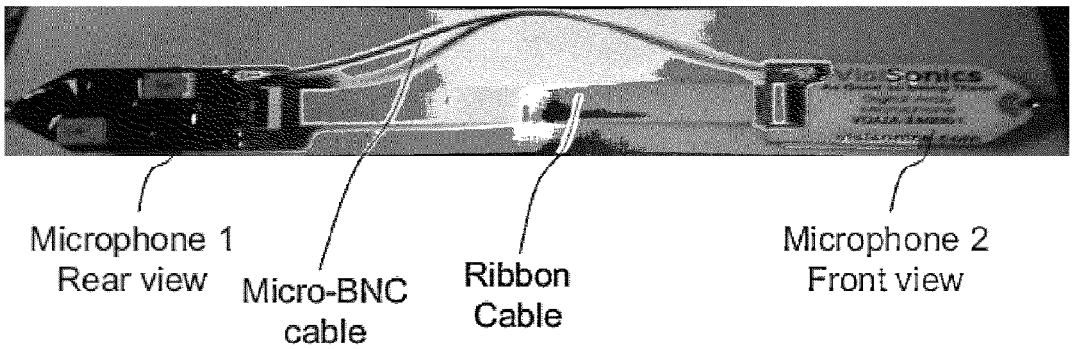
FIG. 3A illustrates an example microphone array configuration consisting of two microphone units comprising a single chain connected in a series.

FIG. 2A provides a zoomed-in view of the connector portion of FIG. 1A. The FFC cable connector and a micro-BNC connector are shown with a higher resolution in this figure. Similarly, FIG. 2B is a zoomed-in view of the connector portion of FIG. 1B. FIG. 3A illustrates an example microphone array consisting of two microphone units. The micro-BNC connector from one microphone unit may be connected via the coaxial cable to the next microphone unit on an opposite side of the microphone unit's PCB. For example, the first microphone unit may have a micro-BNC connector on a rear side (marked TOSTR in FIG. 2B standing for "TO STRING" and indicating that this connection shall be directed away from the hub along the chain) that is connected to a micro-BNC connector on a front side (marked TOHUB in FIG. 2A standing for "TO HUB" and indicating that this connection shall be directed towards the hub along the chain) of another microphone unit. The FFC cable may also be used to connect the microphone units. The described connector configuration provides a daisy-chain or series type of linkage among the microphone units of the microphone array. In other words, only one microphone unit may be directly connected to a processing unit while all the other microphone units in the chain may not have any direct connection to the processing unit. Rather, the rest of the microphone units may be operatively connected to the processing unit only through other microphone units in the chain.

In FIG. 3A, the connectors used on the left microphone unit are located on the rear side, whereas the connectors used on the right microphone unit are located on the front side. This pattern may be repeated as more microphone units are added to the chain. The connection to the hub board may occur from the front side.

Figure 3B:
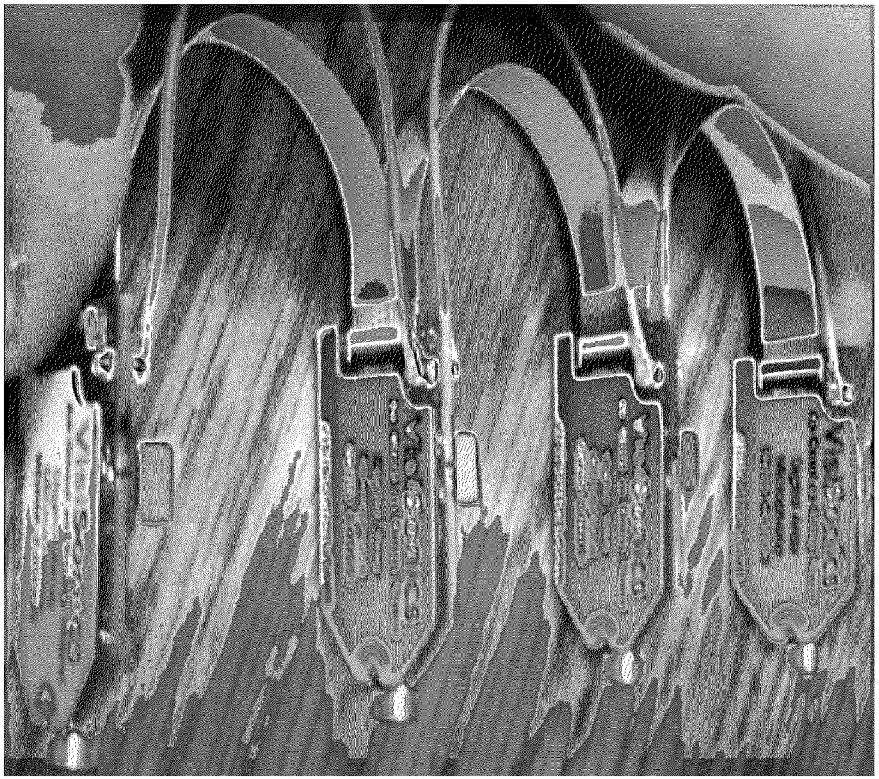
FIG. 3B illustrates an example microphone array configuration consisting of four microphone units comprising a single chain connected in a series.

FIG. 3B illustrates an example microphone array consisting of four microphone units. As may be observed, the same micro-BNC and FFC connections and the same wiring configuration are used as it is explained above with respect to the two-microphone-unit configuration. Similar wiring configuration may also be used for a microphone array configuration consisting of arbitrary number (at least two) of the microphone units. Each micro-SNC connection from the rear of the microphone unit is linked via coaxial cable to the micro-BNC connector on the front of the next microphone unit in the chain. Each FFC cable likewise links the rear of one microphone unit with the front of the next one. All the product labels are shown as being displayed in the same direction with no twists in the cables.

Figure 3C:
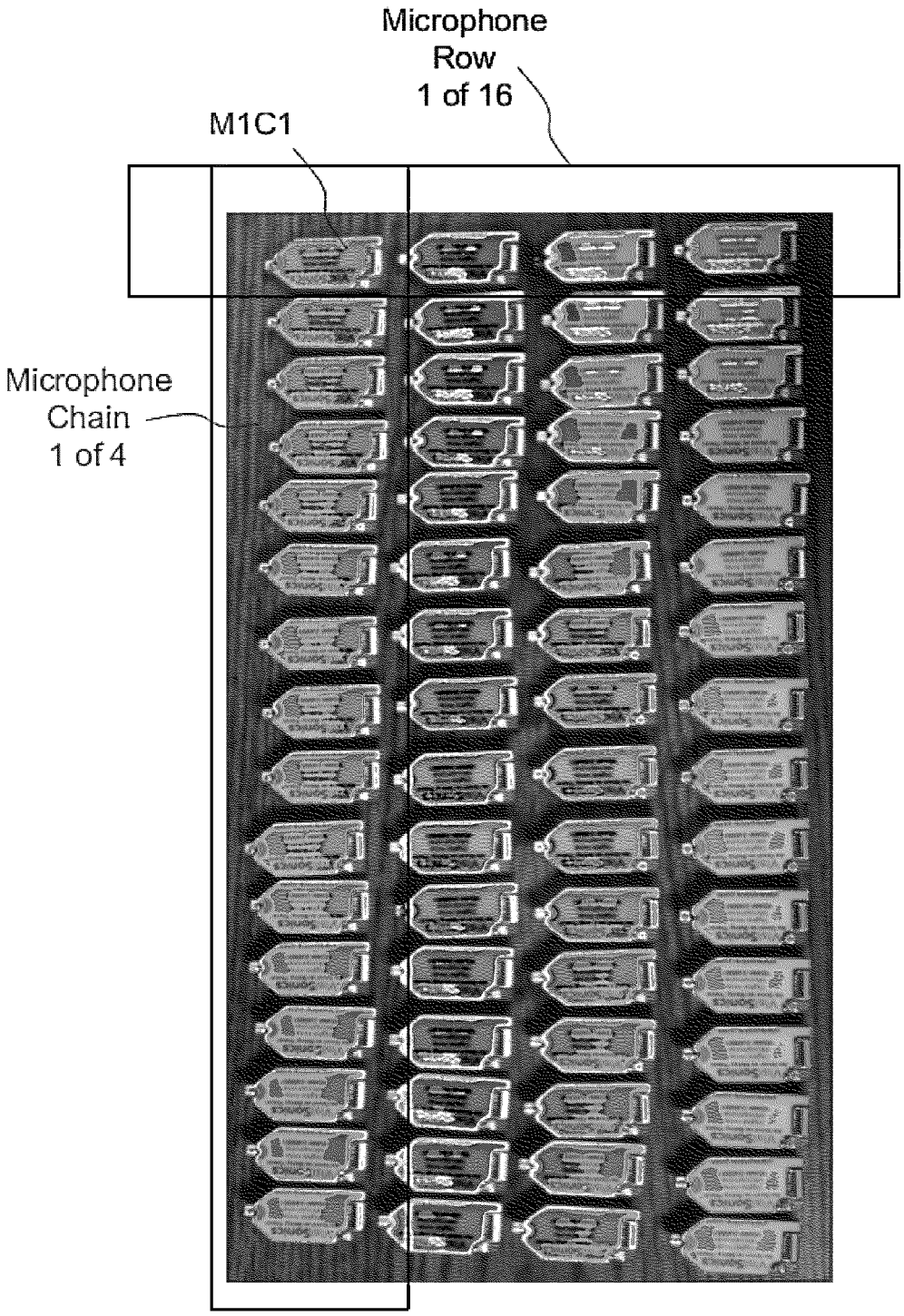
FIG. 3C illustrates an example 64-channel microphone array configuration comprising four chains, each chain consisting of sixteen microphone units connected in a series.

FIG. 3C illustrates an example 64-channel microphone array configuration comprising four chains, each chain consisting of sixteen microphone units connected in a series according to an example embodiment. Each microphone unit may have a digitizing device and its own internal memory, and the array may include a plurality of microphone units receiving a number of different audible sounds and storing them in the internal memory. Each chain may be interfaced via the coaxial cable and the FFC cable to a hub controller. These cables provide a data interface used to receive data from each of the microphone units in the chain. The data transfer may be performed on a turn-taking basis so that the hub may receive data from one chain at a time by alternating chains for each time slot (see detailed description of FIG. 6 below). The configuration presented creates a compact and portable wired microphone array.

Alternatively, the 64-channel microphone array of FIG. 3C may include 64 individual microphone units that are wired to one another in a single, 64-unit long serial chain.

The signal propagating along the chain may deteriorate due to the length of the chain. A signal boosting buffer board may be introduced periodically to increase the maximum number of microphone units along a single chain.

Figure 4A:
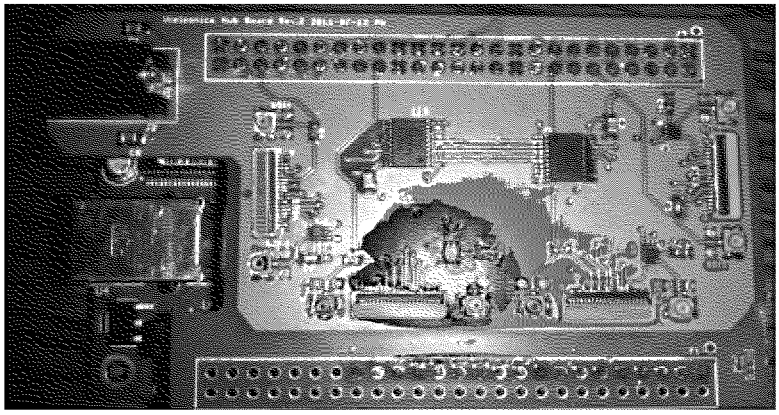
FIG. 4A illustrates various hardware elements of a printed circuit board (PCB) comprising a central controlling unit ("hub board") designed for connecting up to four microphone chains.

FIG. 4A illustrates example hardware configuration of the interface configured to connect to the chain-architecture microphone array. The printed circuit board (PCB) shown comprises a central controlling unit ("hub board") designed for connecting up to four microphone chains. Multiple FFC interfaces (four FFC interfaces are shown, but the circuit may include more FFC interfaces) and multiple micro-BNC interfaces (four are shown, but the circuit may include more micro-BNC interfaces) may be included on a single hub board. The hub board may connect to an FPGA controller interface board. Alternatively, the hub board and the FPGA board may be integrated into a single device board. The four chains of microphone units may be connected to four different interfaces in the same manner. The FFC cable leaving the front side of the first microphone unit in the chain may be connected to the FFC cable connector on the hub board and the micro-BNC connector on the front side of the first microphone unit in the chain may be connected to the micro-BNC connector adjoining the said FFC cable connector on the hub board.

Figure 4B:
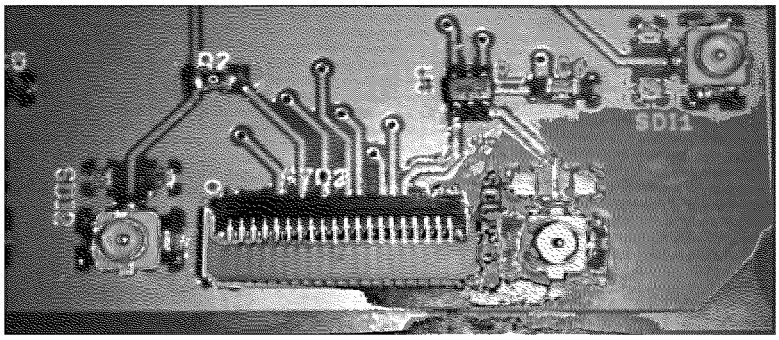
FIG. 4B illustrates a close-up view of connector designed for interfacing a single microphone chain on PCB of FIG. 4A.

FIG. 4B illustrates a close-up view of the huh board interface configured for connecting one microphone chain (i.e., a chain connection interface). There are two micro-BNC connectors on both sides of the FFC cable connector. One micro-BNC connector may remain unused for this configuration. The coaxial cable from the microphone unit may connect to other micro-BNC connector.

Figure 4C:
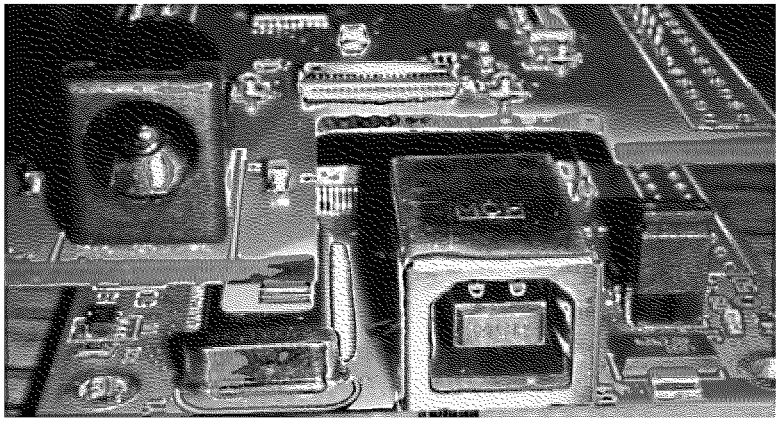
FIG. 4C illustrates a close-up view of a power cable and USB connectors on PCB of FIG. 4A.

FIG. 4C illustrates a close-up view of the power cable connector used to supply operating power and of the Universal Serial Bus (USB) cable connector used to interface with the computer. Before connecting the power cable and the USB cable to the hub, the chain(s) of microphone units should be connected to the hub ensuring correct orientation of the microphone unit.

Figure 5A:
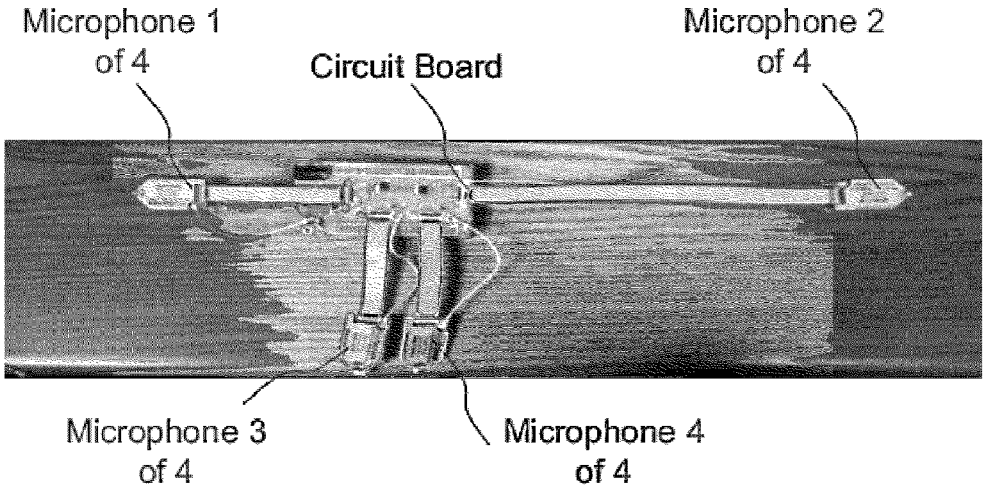
FIG. 5A illustrates an example hub-and-spoke microphone array configuration of four microphone units connected to a single hub board.

FIG. 5A illustrates an example mixed hub-and-spoke and chain-architecture microphone array configuration of four microphone units connected to a single hub board. In this example, there are four microphone units connected to each of the 4 chain connection interfaces on the hub device. The coaxial cable may connect to the micro-BNC connector on the hub board to the right of the FFC cable connector on the hub board when viewed from above. The FFC cable and the coaxial cable may be connected to the front side of each microphone unit. In this example, each chain has only one microphone unit. However, a chain may have a larger number of microphone units connected in series and sharing a common connection to the hub.

Figure 5B:
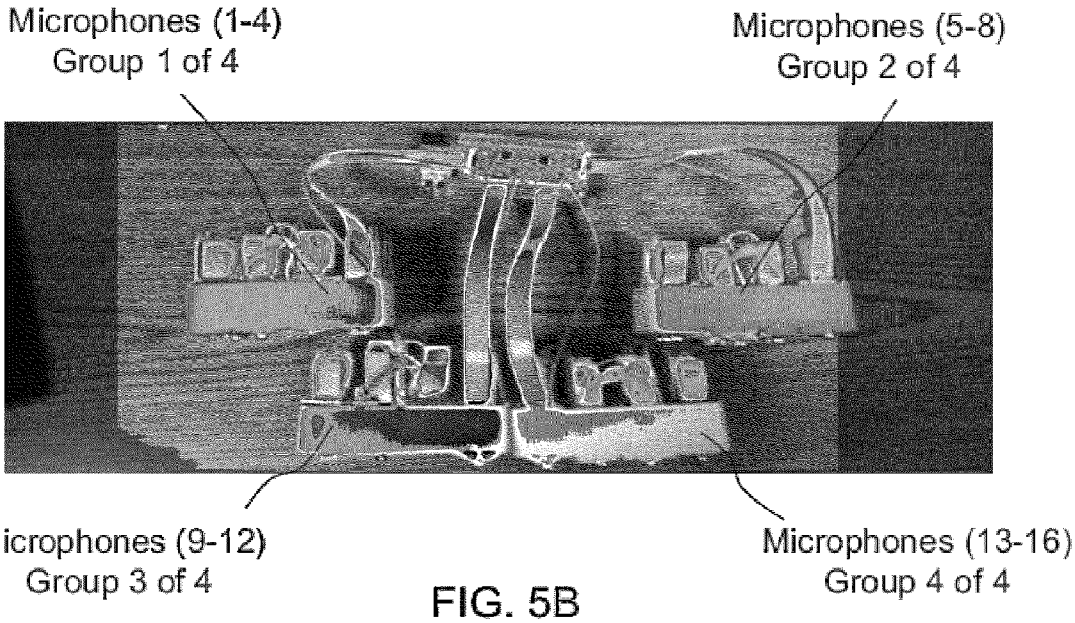
FIG. 5B illustrates an example combined hub-and-spoke/chain-architecture microphone array configuration comprising four chains, each chain consisting of four microphone units connected in a series to a central hub board.

FIG. 5B illustrates an example mixed hub-and-spoke and chain-architecture microphone array configuration of four chains of four microphone units each (sixteen microphone units in total) connected to a single hub board. Each microphone unit is part of one of the four chains with four of the microphone units being part of one chain and other groups of four microphone units being part of other chains (e.g., chain 1=microphone units 1-4, chain 2=microphone units 5-8, chain 3=microphone units 9-12, and chain 4=microphone units 13-16).

Figure 6:
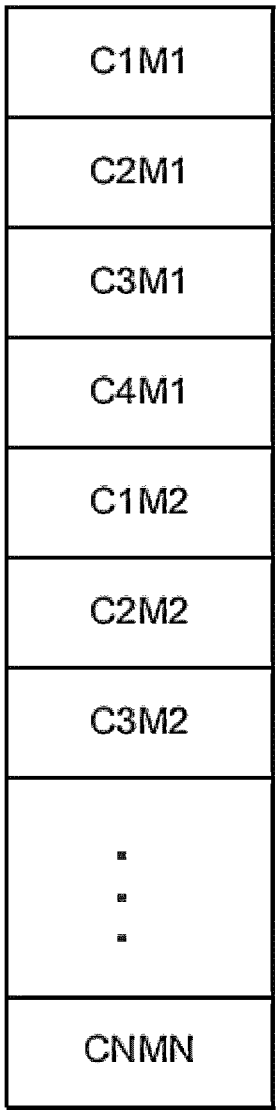
FIG. 6 illustrates an example first-in-first-out (FIFO) microphone data processing configuration for receiving data from different various microphone units comprising the microphone array.

FIG. 6 illustrates an example first-in-first-out (FIFO) microphone data processing configuration for receiving data from various different microphone units of an example 64-channel microphone array. As may be observed from the time and data processing scheme of the FIFO data packet processor example, the first microphone unit (M1) from the first chain (C1) may automatically forward digitized audio data from its local memory before any other unit in the array.

In operation, an audible signal may be recorded simultaneously at a large number of various different microphone units (as illustrated in FIG. 3C). The signals may be received, processed, digitized, and stored locally by each of the microphone units. The microphone units may communicate with the hub device via a store-and-forward type of communication process. As the microphone units communicate with the hub device, the first microphone unit of the first chain (C1M1) may forward (transmit) a data packet(s) to the hub device at a first time slot. Next, the first microphone unit of the second chain (C2M1) may forward (transmit) its audio data packet(s) to the hub. The hub may store the packets in the order received corresponding to each microphone unit in the array.

The organization of received data samples may be performed by interleaving samples from each microphone unit of the array organized by a chain sequence order as described above and picture in FIG. 6. This process may continue until all microphone units have provided their audio data samples to the centralized hub device for processing. The process may repeat for additional cycles of audio signal reception, processing, digitizing, storing, and forwarding operations. The FPGA device may be coupled to the receiving hub, may receive the data stream of packets from the various microphone units, and may provide the data to a computing device via a USB interface, Ethernet connection, wireless connection, IEEE 1394 (Firewire) interface, Bluetooth interface, etc.

The quality of the audio signal ultimately digitized is dependent on the length of the wire over which the analog signal travels. Immediate signal digitization near the microphone capsule may help preserve the audio signal quality.

The operations of a method or algorithm described in connection with the embodiments disclosed herein may be embodied directly in hardware, in a computer program executed by a processor, or in a combination of the two. A computer program may be embodied on a computer readable medium, such as a storage medium. For example, a computer program may reside in random access memory ("RAM"), flash memory, read-only memory ("ROM"), erasable programmable read-only memory ("EPROM"), electrically erasable programmable read-only memory ("EEPROM"), registers, hard disk, a removable disk, a compact disk read-only memory ("CD-ROM"), or any other form of storage medium known in the art.

Figure 7:
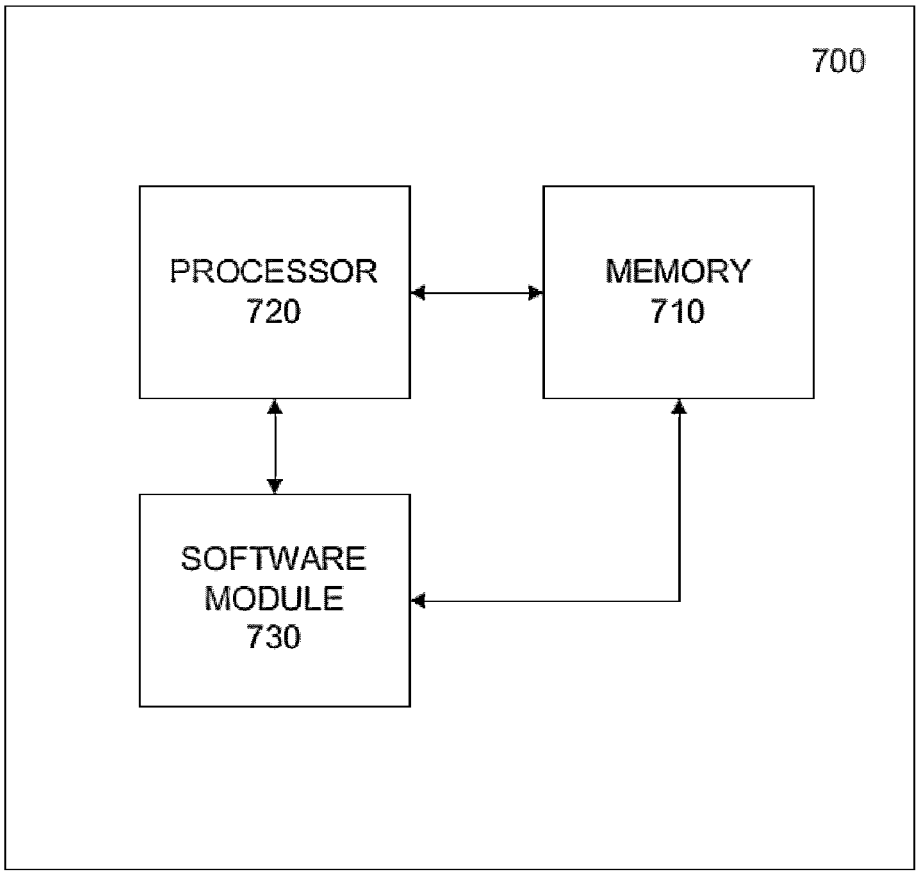
FIG. 7 illustrates an example network entity device comprising necessary hardware configured to store data and instruction (software) for performing various operations according to example embodiments.

An exemplary storage medium may be coupled to the processor such that the processor may read information from, and write information to, the storage medium. In the alternative, the storage medium may be integral to the processor. The processor and the storage medium may reside in an application specific integrated circuit ("ASIC"). In the alternative, the processor and the storage medium may reside as discrete components. FIG. 7 illustrates an example network element 700, which may represent any of the above-described components of the other figures.

As illustrated in FIG. 7, a memory 710 and a processor 720 may be discrete components of the network entity 700 that are used to execute an application or set of operations. The application may be coded in software in a computer language understood by the processor 720 and stored in a computer readable medium, such as, the memory 710. The computer readable medium may be a non-transitory computer readable medium that includes tangible hardware components in addition to software stored in memory. Furthermore, a software module 730 may be another discrete entity comprising part of the network entity 700 and containing software instructions that may be executed by the processor 720. In addition to the above noted components of the network entity 700, the network entity 700 may also have a transmitter and receiver pair configured to receive and transmit communication signals (not shown).

Figure 8A:
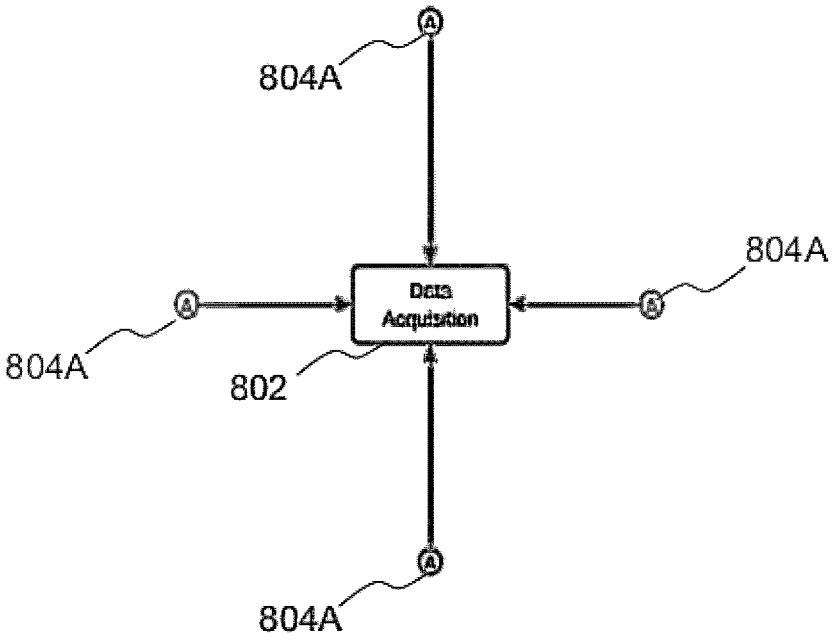
FIG. 8A illustrates an example microphone array configuration of a huh-and-spoke wiring diagram.

FIG. 8A illustrates an example microphone array configuration of a hub-and-spoke wiring diagram. Referring to FIG. 8A, in this example the microphone units 804A are each wired directly to the data acquisition module 802. A data acquisition module 802 is configured to receive the data captured from each of the microphone units 804A. As the sound data is captured, the microphone units 804A may independently receive, process, digitize, store, and/or forward the sound data to the data acquisition module 802.

Figure 8B:
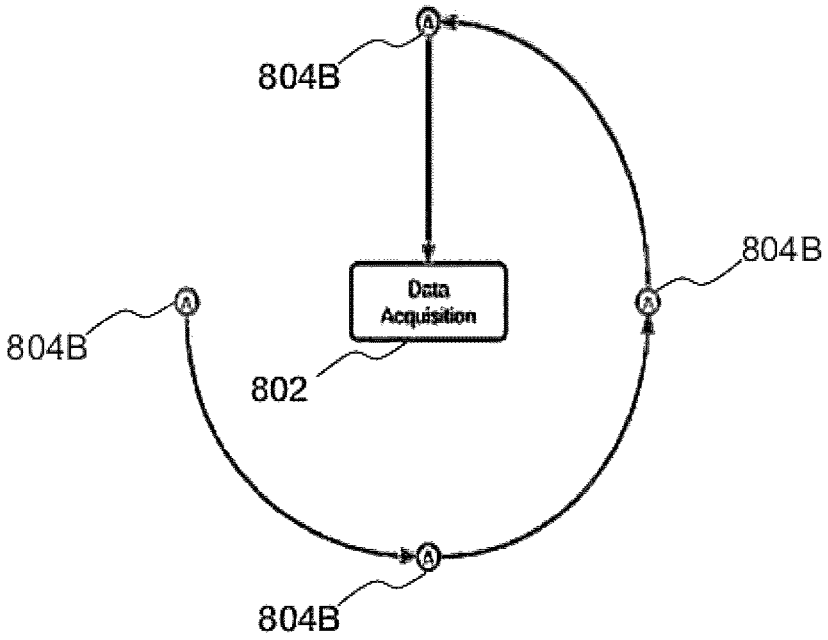
FIG. 8B illustrates an example microphone array configuration of a chain-architecture wiring diagram.

FIG. 8B illustrates an example microphone array configuration of a chain-architecture wiring diagram. Referring to FIG. 8B, in this example multiple different microphone units 804B of a microphone array are wired so as to form a serial configuration. A data acquisition module 802 is configured to receive the data captured from each of the microphone units 804A. Furthermore, each microphone unit is configured to receive the digitized data arriving from the next microphone unit (the one that is located one step further from the data acquisition module 802), to store it locally, and to forward it to the previous microphone unit (the one that is located one step closer to the data acquisition module 802). In this manner, the digitized sound data is transmitted from one microphone unit 804B to another microphone unit 804B along the chain until the sound data is received at the data acquisition module 802. As the sound data is captured, the microphone units 804A may independently receive, process, digitize, store, and/or forward the sound data to the data acquisition module 802.

Depending on the required configuration, the chain-architecture (FIG. 8B) may require more or less cabling that than a comparable hub-and-spoke architecture (FIG. 8A) microphone array. These examples demonstrate the flexibility of the invention allowing the microphone array to be seamlessly modified to accommodate various different microphone array configurations via the most efficient and appropriate combinations of hub-and-spoke and chain architectures.

Figures 9A, 9B:
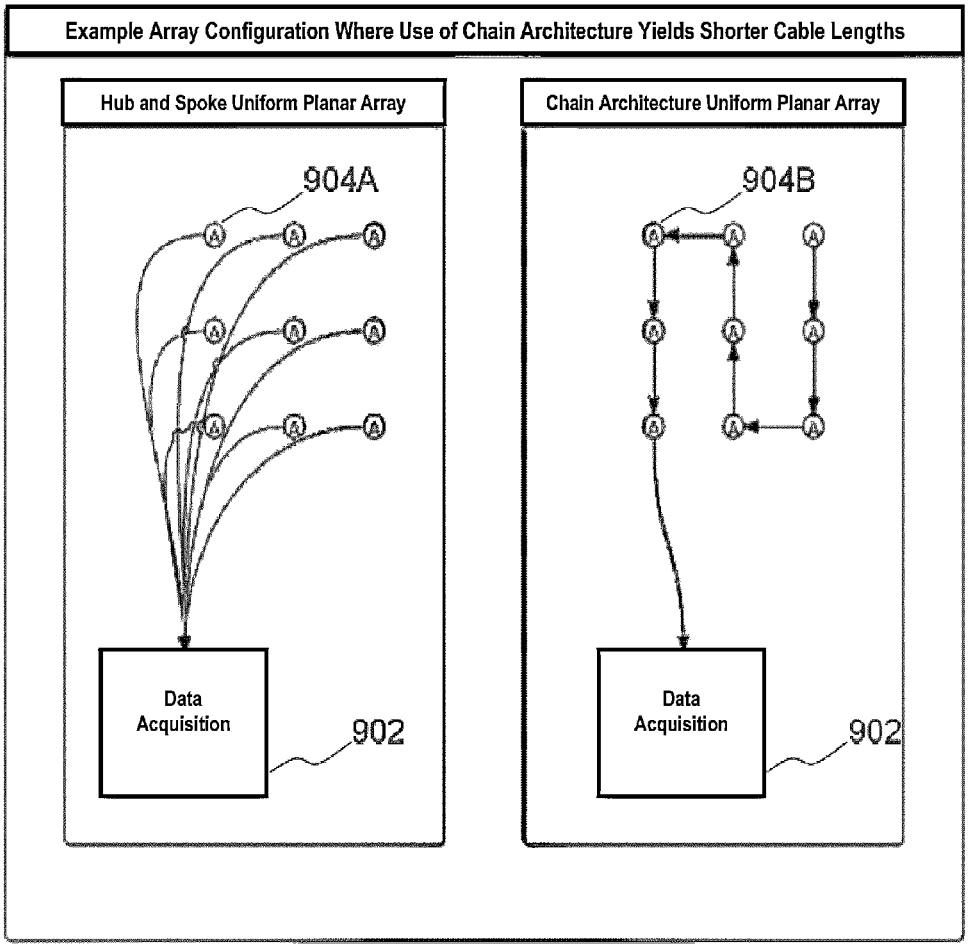
FIG. 9A illustrates an example planar array perspective of a microphone array configuration of a hub-and-spoke wiring diagram.
FIG. 9B illustrates an example planar array perspective of a microphone array configuration of a chain-architecture wiring diagram.

Further demonstrating the strength of the chain architecture, FIGS. 9A and 9B illustrate an example planar array perspective of a microphone array configuration of a respective hub-and-spoke wiring diagram and a chain wiring diagram. FIG. 9A illustrates a hub-and-spoke configuration with multiple different microphone units 904A, each of which is connected directly to the data acquisition module 902. FIG. 9B illustrates a chain architecture configuration with multiple different microphone units 904B, each connected in series to one another and ultimately to a data acquisition module 902. FIGS. 9A and 9B illustrate a microphone array configuration in which it may be optimal to utilize the chain architecture to reduce the total amount of wiring needed in comparison to a hub-and-spoke architecture. The wiring demonstrated in FIG. 9B is significantly shorter than the same in FIG. 9A. In some example configurations, the distance between the data acquisition module and each of the microphone units may be large, in which case the described chain architecture may be used to reduce the total amount of wiring used. In other examples, the hub-and-spoke configuration may use less wire especially if the total distance between the microphone units and the data acquisition module is relatively small. In this manner, the availability of mixed (hub-and-spoke and chain) wiring model of the present invention can help significantly reduce the amount of wire needed for each specific required microphone array configuration and the case of the microphone array manufacturability.

Working Examples

Figure 10:
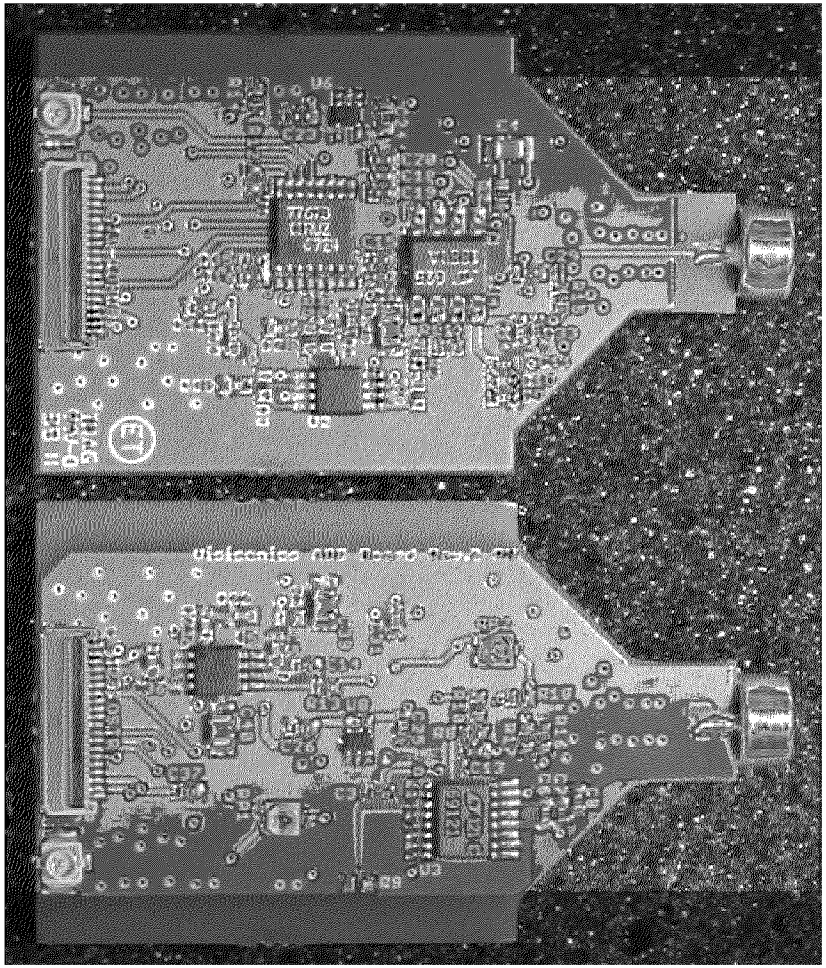
FIG. 10 illustrates a microphone unit that can be used in embodiments of the present invention.

An example embodiment of the chain-architecture hardware solution was developed, designed, and implemented. A sample microphone unit is shown in FIG. 10. The microphone capsule used in the design is Panasonic WM-61A (electret type). The microphone capsule output (audio signal) amplifier is built on an LTC 6912 chip, which is a low-noise AC amplifier with the gain and bandwidth programmable using 3-wire SPI interface. The single-ended output signal is converted to fully differential using THS 4521 chip with unity gain and is fed to the AD 7767 24-bit ADC operating in daisy-chained mode.

There are two separate clocks provided to AD 7767. The first clock (MCLK) serves as a master clock for performing the analog-to-digital conversion. The sampling frequency is equal to the MCLK frequency divided by 8. The second clock (SCLK) controls the output data transfer; at each SCLK pulse, the next bit of data is output on SDO pin. There is also an SDI pin, which is used for daisy-chaining and is connected to the SDO pin on the next board in chain. Input on SDI is shifted into an internal register on each SCLK pulse and then shifted out onto SDO after the ADC has finished outputting its own conversion result. In this way, the data words propagate through the whole chain driven by SCLK. The number of boards in the chain is limited by how fast the read operation can proceed so that all data is consumed before the next conversion starts. In the current setup, the MCLK is 352.8 kHz and the SCLK is 22.5 MHz so that approximately 20 boards can be chained. The maximum SCLK frequency as per ADC 7767 spec sheet is about 42 MHz, allowing one to accommodate more than 32 boards on one chain.

Most of the signals traveling between microphone units are of relatively low frequency, except the data bus (SCLK and SDO/SDI). The inter-unit link is provided by two cables—an 18-pin flat ribbon and a micro-BNC coaxial cable. SCLK is produced by the interface board and is connected in parallel to all microphone units; therefore, it is routed on the coax to minimize distortion and interference. On the other hand, SDO/SDI signal is re-generated at every board and is therefore placed on the flex-ribbon cable. Also the following signals are present on the ribbon cable: SPI CLK, SPI DATA, SPI CS (for LTC 6912 programming); MCLK; ADC CS; ADC RESET; and ADC DRDY. The DRDY line stands for "data ready" and is set by ADC to indicate the end of the conversion. The power is also supplied via the ribbon cable, and each microphone unit has several high-precision voltage regulators for main power, ADC voltage reference, and microphone power.

The chain of microphones is connected via the same dual-cable link to the buffer board containing drivers for high-load signals and further to the interface board. The buffer board is designed for connecting up to four chains at the same time to the same interface board. The interface board is an Opal Kelly XEM3010-1500P product based on Xilinx XCS3S1500-4FG320 Spartan-3 FPGA featuring USB 2.0 interface. A firmware written in Verilog handles the interfacing details such as MCLK/SCLK production; synchronous ADC reset; gain/bandwidth settings transmission over SPI bus; and data acquisition, buffering, and USB transmission when triggered by DRDY. Seven gain settings are possible. The ADC output saturates at 94 dB SPL and at 128 dB SPL for the highest and the lowest possible gain settings respectively.

The Opal Kelly interface board used in the project is bundled with a software package called FrontPanel. The software provides a convenient API for interfacing between C/C++/MATLAB/Java/Python code running on the host PC and the FPGA firmware. From the software engineer point of view, the interface is defined via communication endpoints (pipes). An endpoint is established in firmware, an identifier is assigned to it, and data is streamed into the endpoint controlled by a user-defined clock. On the host computer, the end-point is then opened in a way similar to opening a file or socket and a read operation is issued to obtain the data submitted to the end-point by firmware. Data buffering and USB transfer negotiations are done automatically and seamlessly by Opal Kelly provided drivers operating on the host PC and by a firmware module that may be instantiated in user's FPGA design.

A simple software development kit was developed for use with arbitrary C/C++ applications that have a need to consume the audio stream for online data processing. It has been used to perform source localization and beamforming, to implement a remote audio telepresence application, and to visualize the spatial distribution of the acoustic energy, all in real time. The SDK has the ability to change the microphone gain setting and the acquisition precision (number of bits per sample) dynamically. A basic data acquisition toolkit for MATLAB is provided by Opal Kelly; however, it is not well-suited for online data processing. An alternative SDK to enable real-time data processing in MATLAB is currently under development.

A computer may be used to handle computational and data transfer loads involved. For reference, the USB bandwidth consumed by a 64-microphone array operating at 44.1 kHz at 24 bits per sample is about 11.2 megabytes per second.

Figure 11A:
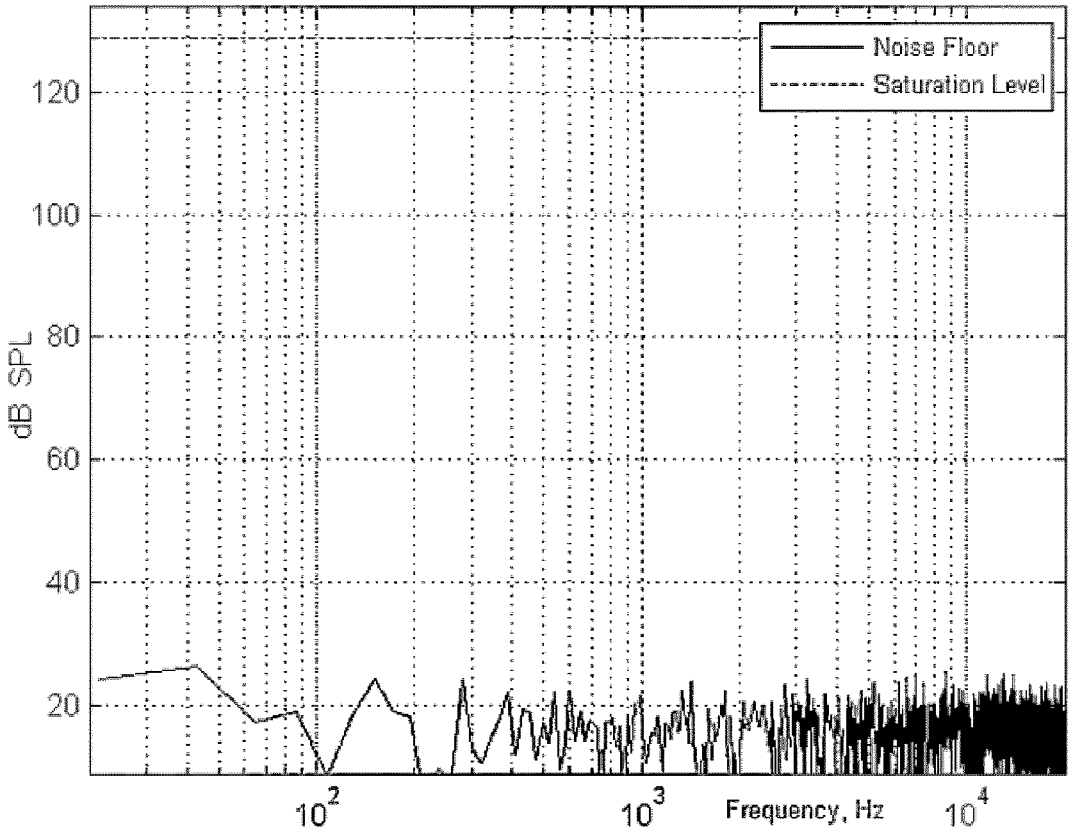
FIG. 11A shows a spectrogram of a signal recorded by a microphone unit placed in an acoustically isolated space.

FIG. 11A shows the spectrum of the sound recorded in silence at the lowest gain setting. A microphone array was placed in a large foam-insulated case, which was shut tight around chain interface cables. Air conditioning and lighting in the room was turned off, and the recording computer was located in an adjacent room. As seen in the FIG. 11A, the noise floor of the array is about 20 dB SPL. A formal computation of the A-weighted equivalent background noise in accordance with IEC 60268-1 (section 6.2.1) gives the value of 23.2 dB SPL. The output saturation point at the same gain is about 128 dB SPL; therefore, the useful dynamic range of the array microphone is about 105 dB.

Figure 11B:
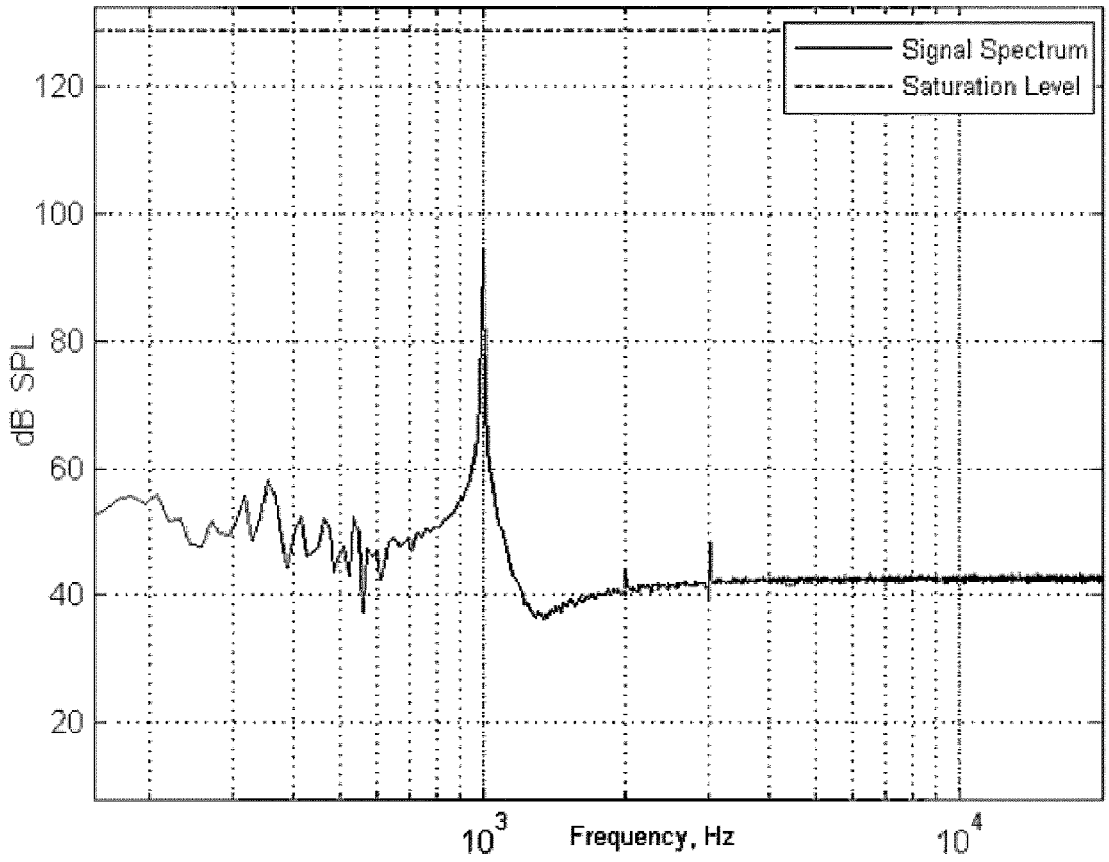
FIG. 11B shows a spectrogram of a 94 dB SPL 1000 Hz calibration signal recorded by a microphone unit.

A signal-to-noise ratio was measured using a PCB Piezotronics CAL 200 pistonphone producing a 94 dB SPL 1000 Hz acoustic signal output. Spectrum of the recorded signal is shown in FIG. 11B. The SNR computed in accordance with is 61.4 dB, which agrees with the SNR specified by the microphone manufacturer. See, for example, H. Zumbahlen, ed. (2006). "Linear Circuit Design Handbook", Elsevier/Newnes, The Netherlands, chapter 6. A measurement of the response flatness was also performed per IEC 61094-5; it was found that the free-field response deviates from that of the reference microphone used (Earthworks M23 measurement microphone on M-Audio Fast Track Pro USB interface) by no more than 2.1 dB over the entire frequency range (0 through 20 kHz).

A data acquisition experiment was also undertaken. The 64-microphone array was placed in the room in the vertical plane with two (horizontal and vertical) linear 32-microphone chains (each consisting of equispaced microphones and spanning approximately 1400 mm) intersecting in the middle. Two persons were speaking at the same time at fixed known positions. A simple delay-and-sum beamformer was implemented in MATLAB for data processing. See, for example, J. McDonough and K. Kumatani (2012), "Microphone arrays," in Techniques for Noise Robustness in Automatic Speech Recognition, ed. by T. Virtanen, R. Singh, and B. Raj, John Wiley & Sons, Inc., Hoboken, N. J. The expected beamforming gain was 18 dB (each doubling of the number of microphones increases the gain by 3 dB). The spatial aliasing limit of the array is approximately 4 kHz. In the useful frequency range, the beamforming gains obtained when steering to the first and to the second speaker were 15.6 and 14.3 dB, respectively. The discrepancy with the theoretical predictions is likely to be due to inaccuracies in microphone position measurements.

Figure 12:
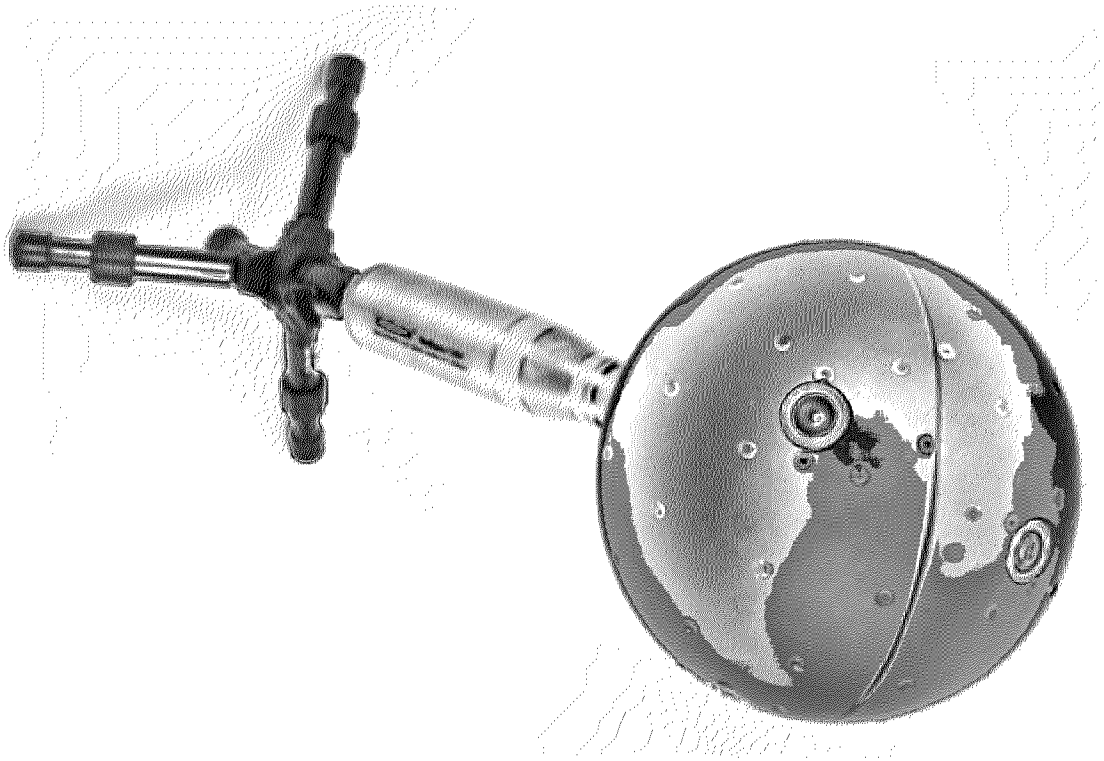
FIG. 12 shows an audio camera that utilizes the microphone array architecture according to embodiments of the present invention.

In conclusion, a portable, low-power, robust microphone array system was designed. The microphones in the array are digitally connected in a chain-like fashion to dramatically reduce the amount of wiring required and to eliminate electromagnetic interference possibilities. An interface board was also developed streaming the audio data over an industry-standard USB 2.0 interface. As such, the array is hot-pluggable into any common desktop/laptop computer with no additional hardware necessary. An accompanying SDK is available for data capture and live data streaming. The audio characteristics of the array microphones are on par with the microphones sold commercially as calibration or reference microphones. The developed hardware can be used to quickly assemble large arbitrary-shaped microphone array and comprises a flexible tool for research and industrial applications; for example, the audio camera shown in FIG. 12 (available from VisiSonics Corp.) employs the described circuitry for audio data acquisition. Individual microphone units and interface boards are also commercially available from VisiSonics.

It will be readily understood that the components of the present invention, as generally described and illustrated in the figures herein, may be arranged and designed in a wide variety of different configurations. Thus, the above detailed description of the embodiments of a method, apparatus, and system, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present invention. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

In addition, while the term "message" has been used in the description of embodiments of the present invention, the invention may be applied to many types of network data, such as, packet, frame, datagram, etc. For purposes of this invention, the term "message" also includes packet, frame, datagram, and any equivalents thereof. Furthermore, while certain types of messages and signaling are depicted in exemplary embodiments of the invention, the invention is not limited to a certain type of message, and the invention is not limited to a certain type of signaling.

While preferred embodiments of the present disclosure have been described, it is to be understood that the embodiments described are illustrative only and the scope of the embodiments is to be defined solely by the appended claims when considered with a full range of equivalents and modifications (e.g., protocols, hardware devices, software platforms etc.) thereto.

What is claimed is:

1. An apparatus comprising:

a plurality of microphone units including at least a first microphone unit and a second microphone unit, each of the first and second microphone units comprising a microphone, an analog-to-digital converter, and a local memory, wherein the microphone is configured to capture an analog audio signal, the analog-to-digital converter is configured to convert the analog audio signal created by the microphone into a digital audio signal, and the local memory is configured to store the digital audio signal; and a controller unit comprising a processor configured to process the digital audio signals, wherein the first microphone unit and the second microphone unit are operatively connected to the controller unit in a series configuration, the second microphone unit being configured to output the digital audio signal to the first microphone unit, and the first microphone unit being configured to output the digital audio signal to the controller unit, and wherein the microphone units in the chain are configured such that:

in one step, the first microphone unit outputs a first digital audio signal generated by the first microphone unit to the controller unit, and the second microphone unit outputs a second digital audio signal generated by the second microphone unit to the first microphone unit, and in a subsequent step, the first microphone unit outputs the second digital audio signal generated by the second microphone unit to the controller unit.

2. The apparatus of claim 1, wherein each of the first and second microphone units further comprises a pre-amplifier configured to amplify the analog audio signal captured by the microphone.

3. The apparatus of claim 1, wherein:

each of the first and second microphone units further comprises a pre-amplifier configured to amplify the analog audio signal captured by the microphone, and the apparatus further comprising a controlling circuit configured to send a signal to the pre-amplifier to apply a predetermined gain.

4. The apparatus of claim 1, further comprising a controlling circuit configured to provide a clock pulse that triggers the analog-to-digital converters to convert the analog audio signal created by the microphone into the digital audio signal and to perform the output of the digital audio signal.

5. The apparatus of claim 1, wherein the second microphone unit is operatively connected to the first microphone unit via a patch cable.

6. The apparatus of claim 1, wherein the apparatus comprises a chain of at least four of the microphone units operatively connected to the controller unit in a series configuration.

7. The apparatus of claim 1, wherein the apparatus comprises at least two separate chains of the microphone units operatively connected to the controller unit in a parallel configuration, each of the microphone units of the at least two chains being operatively connected to the controller unit in a series configuration.

8. The apparatus of claim 1, wherein:

the apparatus comprises at least two separate chains of the microphone units operatively connected to the controller unit in a parallel configuration, each of the microphone units of the at least two chains being operatively connected to the controller unit in a series configuration, and each of the at least two chains comprises at least four of the microphone units connected in a series configuration.

9. The apparatus of claim 1, wherein:

the apparatus comprises at least four separate chains of the microphone units operatively connected to the controller unit in a parallel configuration, each of the microphone units of the at least four chains being operatively connected to the controller unit in a series configuration, and each of the at least four chains comprises at least sixteen of the microphone units connected in a series configuration.

10. The apparatus of claim 1, wherein the local memory is a part of the analog-to-digital converter.

11. The apparatus of claim 1, wherein:

the apparatus comprises a chain of at least four of the microphone units operatively connected to the controller unit in a series configuration, including the first microphone unit, the second microphone unit, a third microphone unit, and a fourth microphone unit, and the microphone units in the chain are configured such that:

in one step, the first microphone unit outputs a first digital audio signal generated by the first microphone unit to the controller unit, the second microphone unit outputs a second digital audio signal generated by the second microphone unit to the first microphone unit, the third microphone unit outputs a third digital audio signal generated by the third microphone unit to the second microphone unit, and the fourth microphone unit outputs a fourth digital audio signal generated by the fourth microphone unit to the third microphone unit, in a subsequent step, the first microphone unit outputs the second digital audio signal generated by the second microphone unit to the controller unit, the second microphone unit outputs the third digital audio signal generated by the third microphone unit to the first microphone unit, and the third microphone unit outputs the fourth digital audio signal generated by the fourth microphone unit to the second microphone unit, in a subsequent step, the first microphone unit outputs the third digital audio signal generated by the third microphone unit to the controller unit, the second microphone unit outputs the fourth digital audio signal generated by the fourth microphone unit to the first microphone unit, and in a subsequent step, the first microphone unit outputs the fourth digital audio signal generated by the fourth microphone unit to the controller unit.

12. The apparatus of claim 1, wherein the controller unit further comprises a memory configured to store the digital audio signals in order based on a time each of the audio signal samples are received.

13. The apparatus of claim 1, wherein:

the controller unit further comprises a memory configured to store the digital audio signals in an order based on a time that each of the audio signal samples are received, and the processor is configured to process the plurality of audio signal samples based on the order in which the memory stores the digital audio signals.

14. The apparatus of claim 1, wherein:

the controller unit further comprises a memory configured to store the digital audio signals in an order based on a time that each of the audio signal samples are received, and a time that each of the audio signal samples are received is based on a chain number and microphone number associated with each of the digital audio signals received.

15. The apparatus of claim 1, wherein:

the apparatus comprises at least two separate chains of the microphone units operatively connected to the controller unit in a parallel configuration, each of the microphone units of the at least two chains being operatively connected to the controller unit in a series configuration, and the controller unit is configured to receive the digital audio signals from one microphone unit at a time by alternating between the at least two separate chains.

16. The apparatus of claim 1, wherein the controller unit comprises a Universal Serial-Bus (USB) interface configured to transmit processed digital audio signals to a computing device.

17. The apparatus of claim 1, wherein:

the apparatus comprises a chain of at least four of the microphone units operatively connected to the controller unit in a series configuration, and the apparatus further comprises a signal booster operatively connected in series between at least two of the at least four of the microphone units.

18. The apparatus of claim 1, wherein the processor is configured for generating an audio image based on the digital audio signals.

19. The apparatus of claim 1, wherein the processor is configured to perform an echo-cancellation process on the digital audio signals.

20. The apparatus of claim 1, wherein the processor is configured to provide an audio image based on the digital audio signals.

21. A method comprising:

providing a plurality of microphone units including at least a first microphone unit and a second microphone unit, each of the first and second microphone units comprising a microphone, an analog-to-digital converter, and a local memory, wherein the microphone is configured to capture an analog audio signal, the analog-to-digital converter is configured to convert the analog audio signal created by the microphone into a digital audio signal, and the local memory is configured to store the digital audio signal;

providing a controller unit comprising a processor configured to process the digital audio signals; and operatively connecting the first microphone unit and the second microphone unit to the controller unit in a series configuration, such that the second microphone unit is configured to output the digital audio signal to the first microphone unit, and the first microphone unit is configured to output the digital audio signal to the controller unit, wherein the microphone units in the chain are configured such that:

in one step, the first microphone unit outputs a first digital audio signal generated by the first microphone unit to the controller unit, and the second microphone unit outputs a second digital audio signal generated by the second microphone unit to the first microphone unit, and in a subsequent step, the first microphone unit outputs the second digital audio signal generated by the second microphone unit to the controller unit.

22. The method of claim 21, wherein the method comprises attaching a plurality of separate chains of the microphone units to the controller unit, wherein a number of separate chains of the microphone units and a number of the microphone units in each separate chain are chosen to optimize a pre-determined cost function.

23. The method of claim 21, wherein the method comprises attaching a plurality of separate chains of the microphone units to the controller unit, and wherein a number of separate chains of the microphone units and the number of the microphone units in each separate chain are chosen to minimize the total cabling length required.

* * * * *